US005799831A

United States Patent [19]

Spriggs et al.

[11] Patent Number: 5,799,831

[45] Date of Patent: Sep. 1, 1998

[54] DUAL ASPIRATOR

[75] Inventors: John R. Spriggs, Minneapolis; Richard Ruhr, Buffalo; Roger Keppers, St. Paul, all of Minn.

[73] Assignee: Ecolab Inc., St. Paul, Minn.

[21] Appl. No.: 619,033

[22] Filed: Mar. 20, 1996

[51] Int. Cl.[6] ..... B67D 5/60

[52] U.S. Cl. ..... 222/132; 222/145.2; 222/145.6; 222/148; 222/195; 137/889; 137/890; 137/895

[58] Field of Search ..... 222/132, 145.2, 222/145.5, 145.6, 148, 195, 394; 137/238, 889, 890, 895; 417/160

[56] References Cited

U.S. PATENT DOCUMENTS

| | | | |
|---|---|---|---|
| 3,304,564 | 2/1967 | Green et al. | 417/160 X |
| 3,635,601 | 1/1972 | Larson et al. | 417/191 |
| 3,756,457 | 9/1973 | Holmes et al. | 222/1 |
| 3,941,355 | 3/1976 | Simpson | 222/145.2 X |
| 4,012,822 | 3/1977 | Vrolyk et al. | 222/145.6 X |
| 4,549,676 | 10/1985 | Gerich | 222/148 X |
| 4,778,083 | 10/1988 | Decker | 222/145.2 X |
| 4,860,795 | 8/1989 | Oten | 137/895 X |
| 5,270,013 | 12/1993 | Decker | 222/132 X |

FOREIGN PATENT DOCUMENTS 1300614 12/1972 United Kingdom .

*Primary Examiner*—Joseph Kaufman

*Attorney, Agent, or Firm*—Merchant, Gould, Smith, Edell, Welter & Schmidt, P.A.

[57] ABSTRACT

A foaming system 10 includes a dual aspirator 13. The dual aspirator 13 has first and second aspirators 80 and 81 to pick up a first and second chemical concentrate. The diluent first chemical mixture is drawn in through the first aspirator 80 and goes through a first diffuser 46 where the first chemical/diluent mixture is further mixed. Similarly, diluent/chemical mixture is drawn by the second aspirator 81 and flows through a second diffuser 47 where it also is mixed. The two diluent/chemical mixtures then combine after exiting the diffusers and the compatible chemicals are then mixed by the flow of the diluent/chemical mixtures. Flushing lines 68 and 71 provide for cleaning of the dual aspirator 13. Further, the diffusers have a ratio of their diameter to length to aid in the prevention of contamination along with the use of two check valves 48 and 49.

17 Claims, 3 Drawing Sheets

DUAL ASPIRATOR

BACKGROUND OF THE INVENTION

1. Field of the Invention

This invention relates generally to a dual aspirator for mixing two chemicals with the same diluent, and more particularly to a dual aspirator wherein the two chemicals being mixed are incompatible.

2. Description of the Prior Art

Aspirators are commonly used when it is necessary to mix a concentrate with a diluent. This is an effective manner of mixing the concentrated chemical and delivering a mixture with a lower concentration. However, it is often necessary to mix two incompatible or highly reactive concentrates and also desirable to subsequently foam this mixture of the two concentrates.

One method in the prior art of mixing two such concentrates required that the concentrates be diluted manually or off-stream and then injected them with motor powered pumps into a common line. This was typically used to avoid unwanted reactions and the associated risks of fouling or plugging of the equipment.

Dual aspirators are known, but have not been found to be suitable for the mixing of two incompatible or reactive concentrates. One example of such a dual feeder is disclosed in U.S. Pat. No. 3,756,457. This patent discloses a dual feeder for feeding additives from a pair of additive reservoirs into a stream of water for making a mixture suitable for a dishwashing machine. The dual feeder contains means for automatically cutting off additive from one of the reservoirs when the additive in the other reservoir is exhausted. There is provided in this dual feeder a venturi means and aspirator tubes. Two venturis are interconnected at the throat portions by conduit. Each aspirator includes an aspirator port communicating directly with the mixing chamber of the other venturi so that the aspirators are in communication with each other. The venturis discharge into a common mixing chamber which is connected to an exit pipe.

Another apparatus for feeding a multiple number of products simultaneously is disclosed in U.S. Pat. No. 3,635,601. The apparatus includes a valve body having valving means positioned within a cavity which is divided into a first and second valving compartment. There is also provided a separate venturi aspirator in communication with each of the compartments. When the supply of a fluid additive to the venturi is exhausted, the valving means is moved to an unbalanced position, thereby terminating the aspiration of either one or two of the additives.

The present invention addresses the problems associated with the prior art devices and provides for a dual aspirator with the ability to mix or proportion two or more diluted chemicals. If the chemicals are incompatible concentrates, they can be mixed without the associated problems of gelling, off-gassing, or excessive heated generation associated with the prior art.

SUMMARY OF THE INVENTION

The invention is a dual aspirator for mixing first and second chemicals with a diluent. The aspirator includes a valve body and means for defining a cavity in the body. The cavity has first and second chemical inlet ports, first and second mixture outlet ports, and a diluent entrance opening. First and second aspirators have inlets and outlets for respectively mixing first and second chemicals with a diluent. The aspirators are positioned in the cavity and the inlets are in fluid communication with the diluent entrance opening and the outlet of the first aspirator is proximate the first mixture outlet port and the outlet of the second aspirator is proximate the second mixture outlet port. A first diffuser has an entrance port proximate the first mixture outlet port and an exit port in fluid communication with the entrance port of the first diffuser. A second diffuser has an entrance port proximate the second mixture outlet port and an exit port in fluid communication with the entrance port of the second diffuser. A diluted chemicals outlet is in fluid communication with the exit ports of the first and second diffusers, wherein when a diluent passes through the diluent entrance opening and into the inlets of the first and second aspirators and the first chemical is mixed with a diluent and passes through the first diffuser and the second chemical is mixed with the diluent and passes through the second diffuser, the first chemical/diluent mixture is mixed with the second chemical/diluent mixture as they exit their respective exit ports into the diluted chemicals outlet. The diffusers have a length and the entrance port has a diameter, wherein the ratio of the length to the diameter is greater than 35.

The invention is a dual aspirator for mixing first and second chemicals with a diluent. The aspirator includes a valve body and means for defining a cavity in the body. The cavity has first and second chemical inlet ports, first and second mixture outlet ports, and a diluent entrance opening. First and second aspirators have inlets and outlets for respectively mixing first and second chemicals with a diluent. The aspirators are positioned in the cavity and the inlets are in fluid communication with the diluent entrance opening and the outlet of the first aspirator is proximate the first mixture outlet port and the outlet of the second aspirator is proximate the second mixture outlet port. A first diffuser has an entrance port proximate the first mixture outlet port and an exit port in fluid communication with the entrance port of the first diffuser. A second diffuser has an entrance port proximate the second mixture outlet port and an exit port in fluid communication with the entrance port of the second diffuser. A diluted chemicals outlet is in fluid communication with the exit ports of the first and second diffusers, wherein when a diluent passes through the diluent entrance opening and into the inlets of the first and second aspirators and the first chemical is mixed with a diluent and passes through the first diffuser and the second chemical is mixed with the diluent and passes through the second diffuser, the first chemical/diluent mixture is mixed with the second chemical/diluent mixture as they exit their respective exit ports into the diluted chemicals outlet. Check valves are positioned proximate the exit ports, wherein backflow through the diffusers is diminished, thereby preventing unwanted mixing of the first and second chemicals.

The invention is a dual aspirator for mixing first and second chemicals with a diluent. The aspirator includes a valve body and means for defining a cavity in the body. The cavity has first and second chemical inlet ports, first and second mixture outlet ports, and a diluent entrance opening. First and second aspirators have inlets and outlets for respectively mixing first and second chemicals with a diluent. The aspirators are positioned in the cavity and the inlets are in fluid communication with the diluent entrance opening and the outlet of the first aspirator is proximate the first mixture outlet port and the outlet of the second aspirator is proximate the second mixture outlet port. A first diffuser has an entrance port proximate the first mixture outlet port and an exit port in fluid communication with the entrance port of the first diffuser. A second diffuser has an entrance port proximate the second mixture outlet port and an exit port in fluid communication with the entrance port of the second diffuser. A diluted chemicals outlet is in fluid communication with the exit ports of the first and second diffusers, wherein when a diluent passes through the diluent entrance opening and into the inlets of the first and second aspirators and the first chemical is mixed with a diluent and passes through the first diffuser and the second chemical is mixed with the diluent and passes through the second diffuser, the first chemical/diluent mixture is mixed with the second chemical/diluent mixture as they exit their respective exit ports into the diluted chemicals outlet. A water inlet has a first end, middle section and second end. The first end is in fluid communication with the pressurized fluid source and the second end is in fluid communication with the entrance cavity. A first chemical conduit is in fluid communication with the first inlet port and a second chemical conduit is in fluid communication with the second inlet port. A first flushing line has a first end in fluid communication with the first chemical conduit and a second end in fluid communication with the middle section of the water inlet. A second flushing line has a first end in fluid communication with the second chemical conduit and a second end in fluid communication with the middle section of the water inlet. Further provided is a means for controlling flow of the diluent through the first and second flushing lines, whereby diluent may be selectively allowed to flow through the flushing lines, and thereby flush the inlet ports, aspirators and diffusers with diluent.

DETAILED DESCRIPTION OF THE PREFERRED EMBODIMENT

Figure 1:
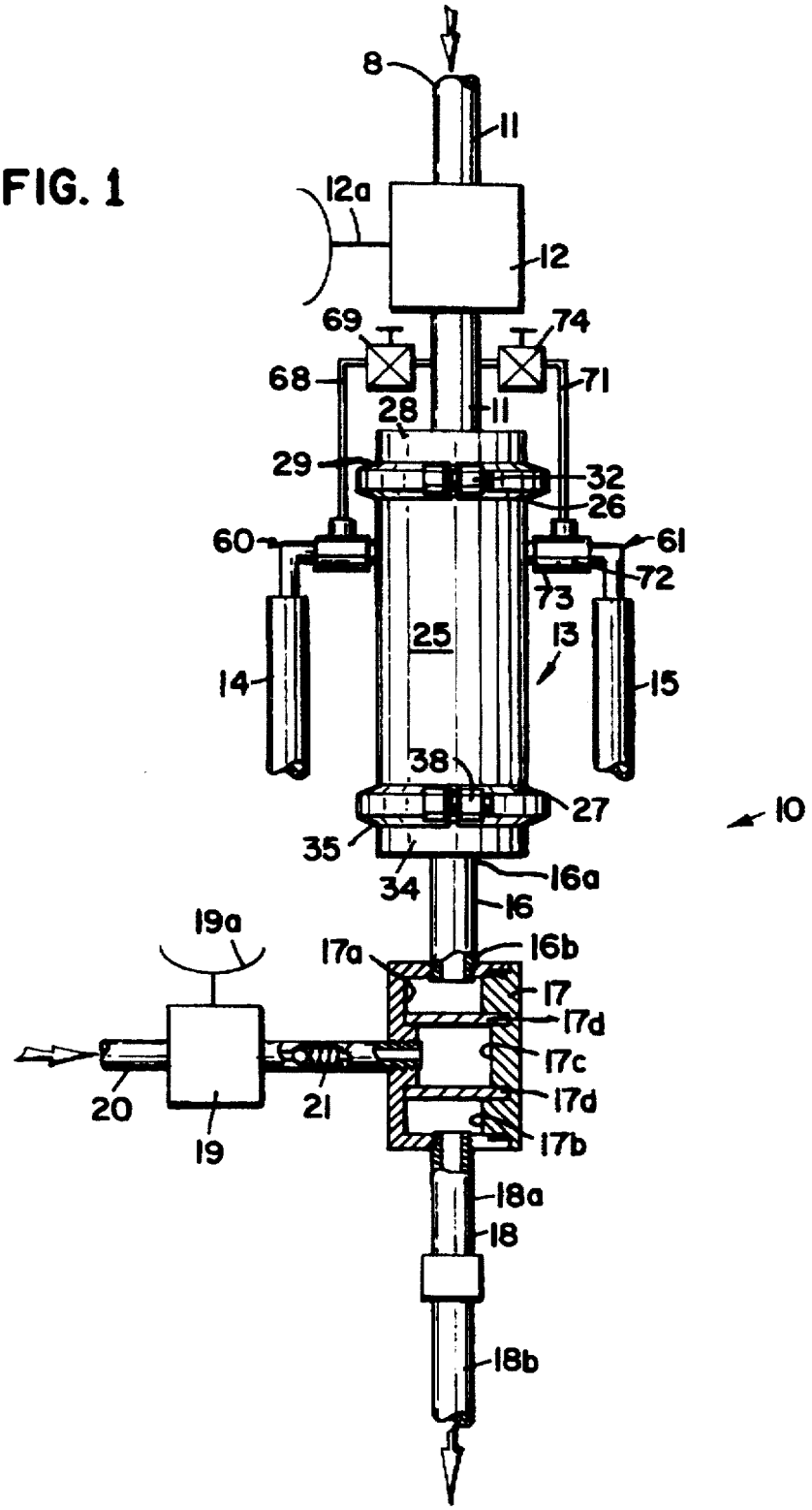
FIG. 1 is front elevational view of a dual aspirator system of the present invention.

Referring to the drawings, wherein like numerals represent like parts throughout the several views, there is generally disclosed at 10 a foaming system. The system 10 includes a water inlet conduit 11 having a first section 8 which has a first end for receiving a source of pressurized diluent (such as water), not shown, and a second end which is in fluid communication with a water pressure regulator 12 and a second portion which is in fluid communication at one end with the water pressure regulator 12 and at its second end a dual aspirator assembly 13. The water pressure regulator 12 may be any suitable regulator and its operation may be controlled by a handle 12*a* or other suitable means such as automatically regulated by means well known in the art. The dual aspirator assembly 13, which will be described in more detail hereafter, has a first chemical concentrate pickup tube 14 and a second chemical concentrate tube 15 in fluid communication with it. The pickup tubes 14 and 15 are in fluid communication with a first and second chemical concentrate (not shown). An outlet conduit 16 has a first end 16a which is in fluid communication with the dual aspirator 13 and a second end 16*b* which is in fluid communication with a mixing chamber 17. A foam conduit 18 has a first end 18*a* in fluid communication with a mixing chamber 17 and a second end 18*b* which provides a foam outlet. An air pressure regulator 19 is in fluid communication with a source of pressurized air (not shown) by means of pipe 20 and is in fluid communication with the mixing chamber 17 by means of pipe 21. The operation of the air pressure regulator 19 may be controlled by a handle 19*a* or other suitable means such as automatic controls, which are well known in the art. The operation and construction of the water pressure regulator 12, water inlet conduit 11, outlet conduit 16, mixing chamber 17, and the air pressure regulator 19 along with pipes 20 and 21, are well known in the art and their operation and construction need not be further defined as they are well known by one skilled in the art. The mixing chamber 17 may be any suitable mixing chamber. As shown in FIG. 1, the mixing chamber 17 includes an inlet area 17*a* and an outlet area 17*b*. The mixing chamber 17*c* is bounded by two porous cylindrical members 17*d*. The inlet pipe 21 may have a suitable check valve such as that shown in FIG. 1. The check valve may be a ball and spring located within the pipe 21.

The dual aspirator assembly 13 has a generally cylindrical housing 25. The cylindrical housing 25 has an upper rim 26 as well as a lower rim 27. Operatively connected to the top of the cylindrical housing 25 is top a generally cylindrical cap 28. Operatively connected to the cap 28 is a base 29. An O-ring 30 is positioned between the base 29 and the upper rim 26. A coupling clamp 31 is placed around the base 29 and upper rim 26 and secured with a wing nut 32 or other suitable means. This provides for a liquid tight seal between the cap 28 and the housing 25. One example of a suitable coupling clamp would be a Tri-Clover hinged clamp with wing nut, Part No. 13MHHM-2 available from Tri-Clover, Inc. It is also understood that other suitable coupling clamps may also be used. A threaded bore 33 is formed through the cap 28.

Operatively connected to the bottom of the cylindrical housing 25 is a cylindrical bottom member 34. Operatively connected to the bottom member 34 is a top lip 35. An O-ring 36 is positioned between the top lip 35 and the lower rim 27. A coupling clamp 37 is placed around the top lip 35 and lower rims 27 and secured with a wing nut 38 or other suitable means. This provides for a liquid tight seal between the bottom member 34 and the housing 25. The clamp 37 is similar to clamp 31. A threaded bore 39 is formed through the bottom member 34. The housing 25, cap 28 and bottom member 34 are preferably 316 stainless steel, although other suitable materials may be used.

A generally cylindrical insert 40 is sized to fit inside of the cylindrical housing 25. The insert in constructed from PVDF thermoplastic material although other suitable material may also be used. At the top end of the insert 40 is formed an entrance cavity 41. The entrance cavity 41 is in fluid communication with the diluent entrance opening formed at the end of the threaded bore 33. First and second threaded aspirator bores 42 and 43 are formed in the cavity and generally parallel to the longitudinal axis of the housing. The aspirator bores 42 and 43 are shown as threaded and are formed in the insert 40 proximate the end of the diluent entrance cavity 41. First and second threaded chemical inlet ports 44 and 45 are also formed in the insert and are generally at a 90° angle to the aspirator bores 42 and 43. The threaded inlet port 44 is positioned proximate an opening 25*c* in the housing and the inlet port 45 is positioned proximate an opening 25*d* in the housing 25. A first mixing compartment 90 is formed at the end of the first threaded chemical inlet port 44 and a second mixing compartment 91 is formed at the end of the second threaded chemical inlet port 45. The mixing compartment 90 has a first mixture outlet port 90*a* and the second mixture compartment has a second mixture outlet port 91*a*. An O-ring 95 is positioned around the top of the insert 40 between the insert and housing 25. Similarly, an O-ring 96 is positioned around the bottom of the insert 40 between the insert and housing 25. The O-rings 95 and 96 are to prevent leakage of the diluent and chemicals between the housing and insert.

Figure 2:
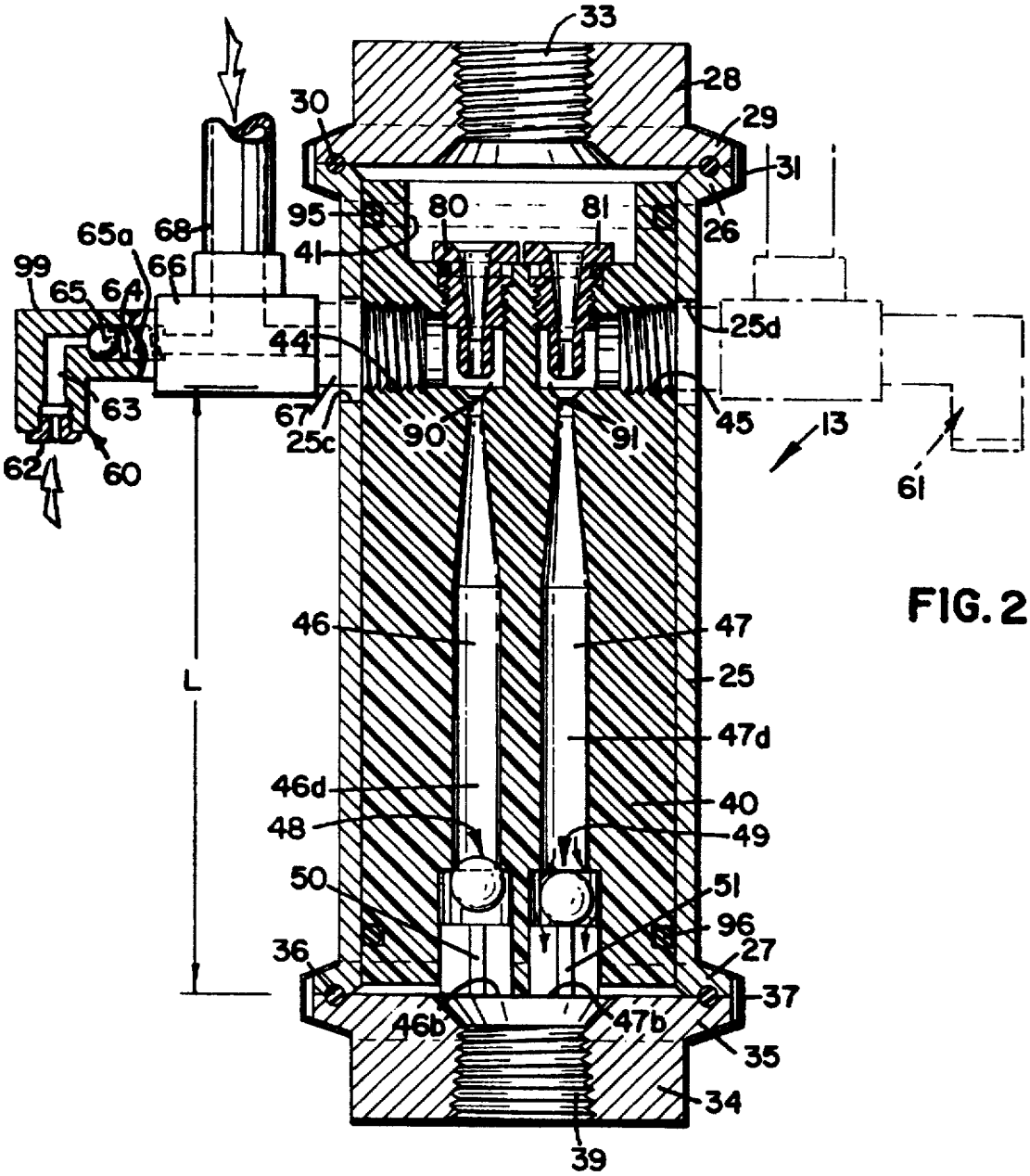
FIG. 2 is a cross-sectional view of the dual aspirator portion of the system shown in FIG. 1.
Figure 3:
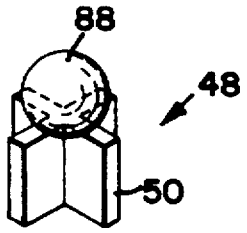
FIG. 3 is a perspective view of the check valve of the dual aspirator shown in FIG. 2.
Figure 4:
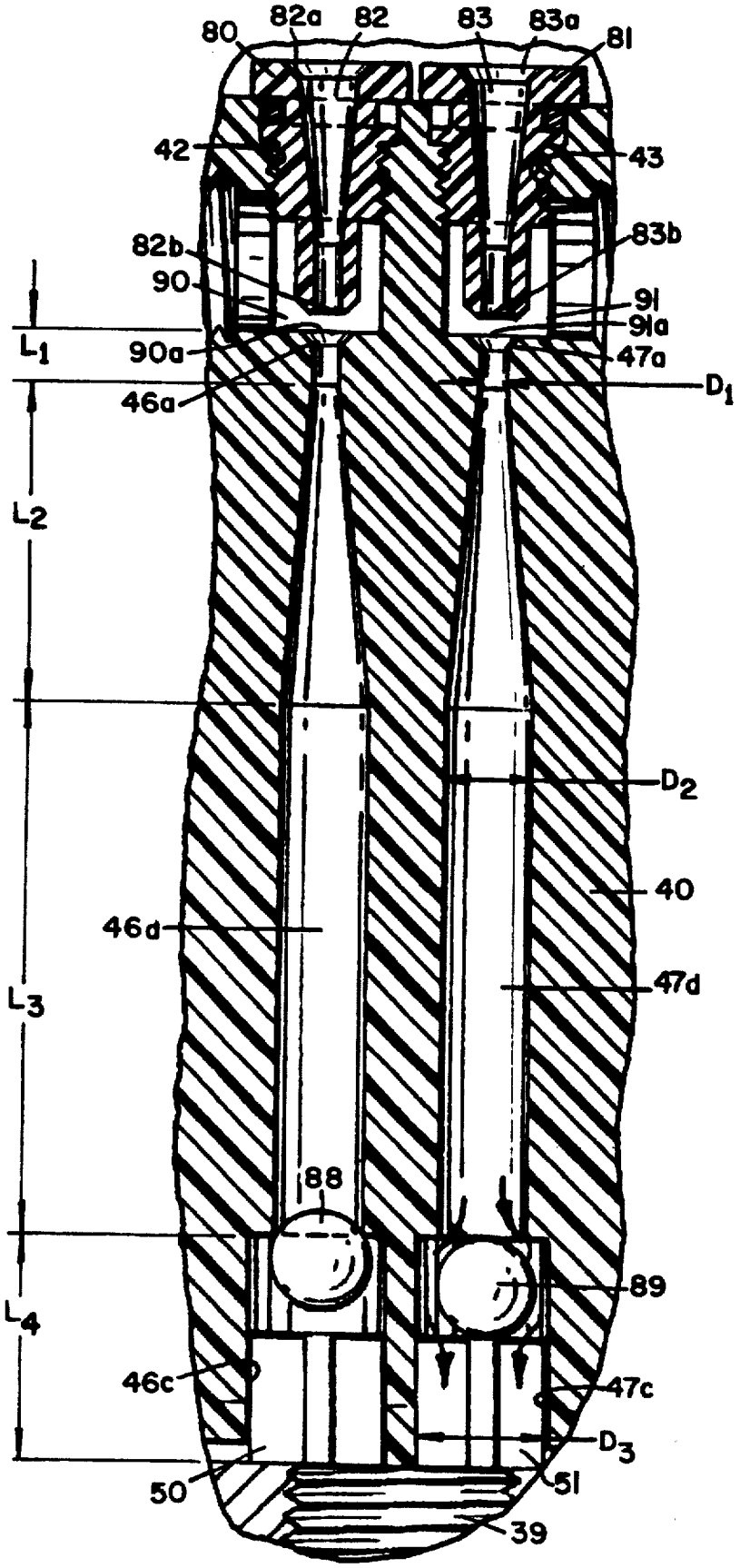
FIG. 4 is an enlarged cross-sectional view of a portion of the dual aspirator shown in FIG. 2.

First and second diffusers 46 and 47 are formed in the insert 40. The diffusers 46 and 47 have entrance ports 46*a* and 47*a* respectively and exit ports 46*b* and 47*b*, respectively. The entrance ports 46*a* and 47*a* have a diameter $D_1$. The diffusers have an overall length designated L. A first section has the same diameter $D_1$. The diffusers then have a middle section which is in a conical shape wherein the diameter of the diffuser gradually increases in its conical shape to a larger diameter $D_2$ where the diameter of the diffusers then continue to be constant in the third cylindrical section. Then, proximate the end of the diffusers, are fourth sections 46*c* and 47*c* having diameters $D_3$ at exits ports 46*b* and 47*b*. The exit ports 46*b* and 47*b* are in fluid communication with the threaded bore 39. Check valves 48 and 49 are positioned proximate the end of the diffusers 46 and 47. The check valves 48 and 49 include a T-shaped platform 50 and 51 respectively. The check valves 48 and 49 are identical and the check valve 48 is shown in more detail in FIG. 3. The platforms 50 and 51 rest on the bottom member 34. The check valve 48 also includes a ball 89. The ball 88 has a diameter which is sized to be able to seal the diffuser where the diameter increases to $D_3$. Similarly, check valve 49, with ball 89, is capable of sealing the second diffuser 47. The balls 88 and 89 are free to float in the fourth section between the platform and the top of the fourth section depending on the forces on the balls. As shown in FIG. 2, the check valve 48 would be sealing flow through the diffuser 46. The check valve 49, shown in FIG. 2, allows flow through the diffuser 47, although this is shown for illustrative purposes as typically both valves would be in the same position. In one example, the length L is 3.814 inches, $D_1$ is 0.100 inches, $D_2$ is 0.281 inches, $D_3$ is 0.437 inches. The length $L_1$ of the first section is 0.187 inches, the length $L_2$ conical section is 1.250 inches, the third section is 1.627 inches in length and the fourth section is 0.750 inches in length.

The pickup tubes 14 and 15 have a metering assembly 60 and 61 respectively. The metering assemblies are similar and only metering assembly 60 will be describe in detail, it being understood that metering assembly 61 is similar. The metering assembly 60 includes a housing 99 and a replaceable metering tip 62. Various metering tips 62 may be used depending on the flow desired. A bore 63 is formed through the housing 61. The bore 63 extends from the metering tip 62 to the exit orifice 64. As shown in FIG. 2, the bore 63 has a 90° turn so as to conform to the general shape of the housing 61. Although it is understood that the bore 63 could be straight or any other suitable configurations. The bore 63 enlarges proximate the exit orifice 64 and a check ball 65 is positioned inside of the enlarged section of bore 63 and functions as a check valve. A spring 65*a* biases the check ball 65 to a closed position. A threaded pipe 67 has its first end operatively connected to the first threaded chemical inlet port 44 and its other end operatively connected to a T coupling 66. Also operatively connected to the T coupling 66 is the housing 61 so that the first chemical concentrate is in fluid communication to the aspirator 13. Operatively connected to the T coupling is a first flushing line 68. The first end of the flushing line 68 is connected to the T coupling 66 and the other end is operatively connected to water inlet conduit 11. A hand valve 69 is placed in the flushing line 68 to control flow of the diluent, as will be more fully described hereinafter. Similarly, a second flushing line 71 is operatively connected at one end to the water inlet conduit 11 and at its other end to a T coupling 72, which is similar to the T coupling 66. A threaded pipe 73 operatively connects the coupling 72 to the second threaded chemical inlet port 45 at one end and the coupling 72 at its other end. A hand valve 74 is positioned in the second flushing line 71 to control flow of the diluent.

A first venturi aspirator 80 is operatively connected to the threaded first aspirator bore 42 and a second venturi aspirator 81 is operatively connected to the threaded second aspirator bore 43. The aspirators 80 and 81 are sized and configured to be secured in the first aspirator bore 42 and second aspirator bore 43 respectively. While shown as threaded it is understood a press fit with O-rings or other suitable means may be used to releasably secure the aspirators 80 and 81 in the bores 42 and 43. The aspirators, as is typical of a number of aspirators, are formed from a single piece of a plastic material such as PVDF (Kynar). The aspirators 80 and 81 have a threaded outer housing to match the threaded bores of the aspirator bore 42 and 43. The aspirators 80 and 81 may be of any suitable type, well known in the art. The aspirators 80 and 81 have respectively passageways 82 and 83 formed therein. The passageways are generally longitudinal and also parallel to the diffusers 46 and 47. The entrance 82*a* of the passageway 82 and entrance 83*a* of passageway 83 are in fluid communication with the entrance cavity 41 and 42 respectively. The exit 82*b* is in fluid communication with the first mixing compartment 90 and exit 83*b* is in fluid communication with compartment 91. The aspirators have conical middle sections connecting the entrances to the exits. While the size of the aspirators may vary depending upon the application, the embodiment shown in FIG. 2, the diameter of the entrance 82*a* is 0.250 inches and the diameter of the exit 82*b* is 0.062 inches and the overall length of the aspirator is 0.812 inches.

The present invention allows for each aspirator to be replaced allowing one side to be adjusted independently of the other side, with no teter-tottering effect, which is usually present with dual aspirators. Both aspirators are independent of each other. The pressure drops and flows are independent of the other.

In use, the pickup tubes 14 and 15 are placed in their respective chemical concentrate containers. The concentrates may be any concentrates which need to be mixed. However, invention is particularly for mixing a two component gel and foaming it thereafter. The two components may be, because of the present invention, incompatible and still not clog easily. While not limited to any particular chemicals being dispensed, examples of incompatible chemicals would include Acusol 820-acrylic or methacrylic copolymers with a 50% caustic solution. Another example would be Sodium Hypochloride NaOCl with surfactants or dyes or builders. The size of the metering orifices in the metering assembly 60 and 61, the diameter of the aspirators and diffusers will depend upon the viscosity requirements and flow characteristics required. These would be determined by one skilled in the art. Water enters through the water inlet conduit 11 and is the diluent which is used in the foaming system 10. The water pressure is regulated by means of the handle 12*a* of the water pressure regulator 12. When opened, the diluent passes through the water inlet conduit 11 and enters the entrance cavity 41. At this point, the valves 69 and 74 are closed so that water does not flow through the flushing lines 68 and 71. Upon entrance into the entrance cavity 41, the diluent enters the aspirators 80 and 81 through the entrances 82*a* and 83*a* and exits the exits 82*b* and 83*b* into the mixing compartments 90 and 91, respectively. The mixing compartments 90 and 91 are not in fluid communication with each other so there is no mixing of the two chemical components. By the action of the water passing through the aspirators 80 and 81, the chemical concentrates are drawn through the pickup tubes 14 and 15, respectively. The flow of the chemical concentrates causes the balls of metering assemblies 60 and 61 allow the flow of the chemical concentrates into the inlet ports 44 and 45 and then into the mixing compartments 90 and 91 respectively. Then, the first diluent and chemical mixture enters the diffuser 46 and the second diluent/chemical mixture enters the diffuser 47. As the diluent/chemical mixtures go through their respective diffusers, the diluent and chemicals are mixed and they then exit the exit ports 46*b* and 47*b* respectively. Then, the two diluent/chemical mixtures mix together as they exit the exit ports and enter the bore 39 and continue to the mixing chamber 17. Then, if the mixture is to be foamed, air pressure, from a suitable source not shown, enters the pipe 20 and is regulated by means of the regulator 19 and enters the mixing chamber 17 by means of pipe 21 and foam is generated. Finally, the foamed mixture exits the mixing chambers and enters the foam conduit 18 and is dispensed through the foam outlet 18*b*.

The check valves 48 and 49 prevent the back flow of the diluent/chemical mixtures such that the mixture from one diffuser does not flow back from the other diffuser into the mixing compartments 90 and 91 where they would tend to foul or plug the aspirator. Still further, Applicants have found that by having the ratio of the length of the diffuser to the diameter of the entrance port of the diffuser, be greater than 35:1 and preferably 35:1 to 50:1, the chance of cross contamination of the chemicals is further reduced. However, it is understood that higher ratios may work but are limited by practical considerations as to the size of the diffuser.

It is then possible, by utilizing the flushing 68 and 71 to easily clean the dual aspirator assembly 13. This is accomplished by simply allowing water to flow through the water conduit 11 and then opening the valves 69 and 74. This allows water to enter the lines 68 and 71 and enter the T couplings. The force of the water entering the couplings pushes the check ball 65 in assembly 60 and the corresponding check ball in assembly 61 so as to seal off the bores of the metering assembly 60 and 61. Therefore, no chemical concentrates can flow and are not picked up by the aspirators. The water than flows through the T coupling into the mixing chamber 90 and 91 and out the diffusers 46 and 47, thereby cleaning the assembly 13. In addition, water is continuing to flow through the conduit 11 and enters the entrance cavity 41 and passes through the aspirators 80 and 81, thereby cleaning the aspirators also.

The dual aspirator assembly 11, as previously described, operatively connected by means of clamps 31 and 37. Therefore, it is an easy matter to change the aspirators 80 and 81 to replace the aspirators with aspirators of a different size, thereby allowing a relatively simply procedure for change the ratio of diluent of any particular additive.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

I claim:

1. A dual aspirator assembly for mixing first and second chemicals with a diluent, comprising:

(a) a valve body;

(b) means defining a cavity in said body, said cavity having first and second chemical inlet ports, first and second mixture outlet ports, and a diluent entrance opening;

(c) first and second aspirators, having inlets and outlets for respectively mixing first and second chemicals with a diluent, positioned in said cavity and said inlets in fluid communication with said diluent entrance opening and said outlet of said first aspirator proximate said first mixture outlet port and said outlet of said second aspirator proximate said second mixture outlet port;

(d) a first diffuser having an entrance port proximate said first mixture outlet port and an exit port in fluid communication with said entrance port of said first diffuser;

(e) a second diffuser having an entrance port proximate said second mixture outlet port and an exit port in fluid communication with said entrance port of said second diffuser;

(f) a diluted chemicals outlet in fluid communication with said exit ports of said first and second diffusers, wherein, when a diluent passes through the diluent entrance opening and into the inlets of said first and second aspirators and the first chemical is mixed with a diluent and passes through the first diffuser and the second chemical is mixed with the diluent and passes through said second diffuser, the first chemical/diluent mixture is mixed with the second chemical/diluent mixture as they exit their respective exit ports into the diluted chemicals outlet; and (g) said diffusers having a length and said entrance ports having a diameter, wherein a ratio of the length to the diameter is greater than 35.

2. The aspirator assembly of claim 1, wherein the ratio of the length to the diameter is from 35 to 50.

3. The aspirator assembly of claim 2, further comprising means for adding a gas to the mixture of the first chemical/diluent mixture and the second chemical/diluent mixture, thereby foaming the combined chemical/diluent mixture.

4. The aspirator assembly of claim 1, further comprising:

(a) a housing having first and second ends;

(b) a cap releasably connected to said first end of said housing;

(c) a base releasably connected to said second end of said housing;

(d) said valve body defining first and second threaded aspirator openings; and (e) said first and second aspirators having external threads, whereby said first and second aspirators are more easily changed.

5. The aspirator assembly of claim 2 further comprising check valves positioned proximate said exit ports, wherein back flow through said diffusers is diminished, thereby preventing unwanted mixing of the first and second chemicals.

6. The aspirator assembly of claim 5, wherein said check valves are ball check valves.

7. The aspirator assembly of claim 1, further comprising:

(a) a water inlet having a first end, middle section and second end, said first end in fluid communication with a pressurized fluid source and said second end in fluid communication with said entrance cavity;

(b) a first chemical conduit in fluid communication with said first inlet port;

(c) a second chemical conduit in fluid communication with said second inlet port;

(d) a first flushing line having a first end in fluid communication with said first chemical conduit and a second end in fluid communication with said middle section of said water inlet;

(e) a second flushing line having a first end in fluid communication with said second chemical conduit and a second end in fluid communication with said middle section of said water inlet; and (f) means for controlling flow of the diluent through said first and second flushing lines, whereby diluent is selectively allowed to flow through said flushing lines and thereby flushing said inlet ports, aspirators and diffusers with diluent.

8. A dual aspirator assembly for mixing first and second chemicals with a diluent, comprising:

(a) a valve body;

(b) means defining a cavity in said body, said cavity having first and second chemical inlet ports, first and second mixture outlet ports, and a diluent entrance opening;

(c) first and second aspirators, having inlets and outlets for respectively mixing first and second chemicals with a diluent, positioned in said cavity and said inlets in fluid communication with said diluent entrance opening and said outlet of said first aspirator proximate said first mixture outlet port and said outlet of said second aspirator proximate said second mixture outlet port;

(d) a first diffuser having an entrance port proximate said first mixture outlet port and an exit port in fluid communication with said entrance port of said first diffuser;

(e) a second diffuser having an entrance port proximate said second mixture outlet port and an exit port in fluid communication with said entrance port of said second diffuser;

(f) a diluted chemicals outlet in fluid communication with said exit ports of said first and second diffusers, wherein, when a diluent passes through the diluent entrance opening and into the inlets of said first and second aspirators and the first chemical is mixed with a diluent and passes through the first diffuser and the second chemical is mixed with the diluent and passes through said second diffuser, the first chemical/diluent mixture is mixed with the second chemical/diluent mixture as they exit their respective exit ports into the diluted chemicals outlet; and (g) check valves positioned proximate said exit ports, wherein back flow through said diffusers is diminished, thereby preventing unwanted mixing of the first and second chemicals.

9. The aspirator assembly of claim 8, further comprising said diffusers having a length and said entrance ports having a diameter, wherein a ratio of the length to the diameter is greater than 35.

10. The aspirator assembly of claim 9, further comprising means for adding a gas to the mixture of the first chemical/diluent mixture and the second chemical/diluent mixture, thereby foaming the combined chemical/diluent mixture.

11. The aspirator assembly of claim 9, further comprising:

(a) a housing having first and second ends;

(b) a cap releasably connected to said first end of said housing;

(c) a base releasably connected to said second end of said housing;

(d) said valve body defining first and second threaded aspirator openings; and (e) said first and second aspirators having external threads, whereby said first and second aspirators are more easily changed.

12. The aspirator assembly of claim 11, wherein said connecting means comprises:

(a) a first connector for operatively connecting said cap to said housing; and (b) a second connector for operatively connecting said base to said housing.

13. The aspirator assembly of claim 9, wherein said check valves are ball check valves.

14. The aspirator assembly of claim 9, further comprising:

(a) a water inlet having a first end, middle section and second end, said first end in fluid communication with a pressurized fluid source and said second end in fluid communication with said entrance cavity;

(b) a first chemical conduit in fluid communication with said first inlet port;

(c) a second chemical conduit in fluid communication with said second inlet port;

(d) a first flushing line having a first end in fluid communication with said first chemical conduit and a second end in fluid communication with said middle section of said water inlet;

(e) a second flushing line having a first end in fluid communication with said second chemical conduit and a second end in fluid communication with said middle section of said water inlet; and (f) means for controlling flow of the diluent through said first and second flushing lines, whereby diluent may be selectively allowed to flow through said flushing lines and thereby flushing said inlet ports, aspirators and diffusers with diluent.

15. A dual aspirator for mixing first and second chemicals with a diluent, comprising:

(a) a valve body;

(b) means defining a cavity in said body, said cavity having first and second chemical inlet ports, first and second mixture outlet ports, and a diluent entrance opening;

(c) first and second aspirators, having inlets and outlets for respectively mixing first and second chemicals with a diluent, positioned in said cavity and said inlets in fluid communication with said diluent entrance opening and said outlet of said first aspirator proximate said first mixture outlet port and said outlet of said second aspirator proximate said second mixture outlet port;

(d) a first diffuser having an entrance port proximate said first mixture outlet port and an exit port in fluid communication with said entrance port of said first diffuser;

(e) a second diffuser having an entrance port proximate said second mixture outlet port and an exit port in fluid communication with said entrance port of said second diffuser;

(f) a diluted chemicals outlet in fluid communication with said exit ports of said first and second diffusers, wherein, when a diluent passes through the diluent entrance opening and into the inlets of said first and second aspirators and the first chemical is mixed with a diluent and passes through the first diffuser and the second chemical is mixed with the diluent and passes through said second diffuser, the first chemical/diluent mixture is mixed with the second chemical/diluent mixture as they exit their respective exit ports into the diluted chemicals outlet; and (g) a water inlet having a first end, middle section and second end, said first end in fluid communication with a pressurized fluid source and said second end in fluid communication with said entrance cavity;

(h) a first chemical conduit in fluid communication with said first inlet port;

(i) a second chemical conduit in fluid communication with said second inlet port;

(j) a first flushing line having a first end in fluid communication with said first chemical conduit and a second end in fluid communication with said middle section of said water inlet;

(k) a second flushing line having a first end in fluid communication with said second chemical conduit and a second end in fluid communication with said middle section of said water inlet; and (l) means for controlling flow of the diluent through said first and second flushing lines, whereby diluent may be selectively allowed to flow through said flushing lines and thereby flushing said inlet ports, aspirators and diffusers with diluent.

16. A dual aspirator assembly for mixing first and second chemicals with a diluent, comprising:

(a) a valve body;

(b) means defining a cavity in said body, said cavity having first and second chemical inlet ports, first and second mixture outlet ports, and a diluent entrance opening;

(c) first and second aspirators, having inlets and outlets for respectively mixing first and second chemicals with a diluent, positioned in said cavity and said inlets in fluid communication with said diluent entrance opening and said outlet of said first aspirator proximate said first mixture outlet port and said outlet of said second aspirator proximate said second mixture outlet port;

(d) a first diffuser having an entrance port proximate said first mixture outlet port and an exit port in fluid communication with said entrance port of said first diffuser;

(e) a second diffuser having an entrance port proximate said second mixture outlet port and an exit port in fluid communication with said entrance port of said second diffuser;

(f) a diluted chemicals outlet in fluid communication with said exit ports of said first and second diffusers, wherein, when a diluent passes through the diluent entrance opening and into the inlets of said first and second aspirators and the first chemical is mixed with a diluent and passes through the first diffuser and the second chemical is mixed with the diluent and passes through said second diffuser, the first chemical/diluent mixture is mixed with the second chemical/diluent mixture as they exit their respective exit ports into the diluted chemicals outlet;

(g) a housing having first and second ends;

(h) a cap releasably connected to said first end of said housing;

(i) a base releasably connected to said second end of said housing;

(j) said valve body having first and second aspirator openings; and (k) said first and second aspirators having means for being releasably connected to said valve body.

17. The dual aspirator of claim 16, wherein said aspirator openings are threaded and said aspirators are threaded.

* * * * *